US012557922B2

(12) United States Patent
Hu

(10) Patent No.: US 12,557,922 B2
(45) Date of Patent: Feb. 24, 2026

(54) CHILD BED

(71) Applicant: WONDERLAND SWITZERLAND AG, Steinhausen (CH)

(72) Inventor: Junjie Hu, Guangdong (CN)

(73) Assignee: WONDERLAND SWITZERLAND AG, Steinhausen (CH)

( * ) Notice: Subject to any disclaimer, the term of this patent is extended or adjusted under 35 U.S.C. 154(b) by 0 days.

(21) Appl. No.: 18/845,551

(22) PCT Filed: Mar. 9, 2023

(86) PCT No.: PCT/EP2023/055962

§ 371 (c)(1),
(2) Date: Sep. 10, 2024

(87) PCT Pub. No.: WO2023/170191

PCT Pub. Date: Sep. 14, 2023

(65) Prior Publication Data

US 2025/0185821 A1 Jun. 12, 2025

(30) Foreign Application Priority Data

Mar. 10, 2022 (CN) ..... 202210233461.8

(51) Int. Cl.
*A47D 9/00* (2006.01)

(52) U.S. Cl.
CPC ..... *A47D 9/012* (2022.08)

(58) Field of Classification Search
CPC ..... A47D 9/012; A47D 7/02; A47D 11/005; A47D 7/01; A47D 11/007; A47D 7/00
(Continued)

(56) References Cited

U.S. PATENT DOCUMENTS 3,763,507 A * 10/1973 Propst ..... A47D 7/00 5/100
6,148,456 A 11/2000 Tharalson et al.
(Continued)

FOREIGN PATENT DOCUMENTS

CN 108338590 A 7/2018
CN 209750534 U 12/2019
(Continued)

OTHER PUBLICATIONS

Translation CN-113425123-A (Year: 2025).*
(Continued)

*Primary Examiner* — J. T. Newton
(74) *Attorney, Agent, or Firm* — HAUPTMAN HAM, LLP

(57) ABSTRACT

A child bed includes a frame. The frame includes a plurality of vertical support members, arranged at corners of the frame. The frame also includes two top side rods, extending longitudinally and arranged transversely opposite to each other on the vertical support members. Each of the top side rods is able to vertically slide between a high position and a low position with respect to the vertical support members. The frame further includes two side pull-rods, extending longitudinally and arranged transversely opposite to each other below the corresponding top side rods. The frame additionally includes two tightening mechanisms. Each one of the side pull-rods is pulled toward the other one of the side pull-rods by a corresponding one of the tightening mechanisms.

14 Claims, 8 Drawing Sheets

(58) Field of Classification Search
USPC ..... 5/100
See application file for complete search history.

(56) References Cited

U.S. PATENT DOCUMENTS

| | | | | |
|---|---|---|---|---|
| 7,055,194 | B2 | 6/2006 | Arthur | |
| 2004/0025251 | A1 | 2/2004 | Arthur | |
| 2005/0251909 | A1 | 11/2005 | Ruiz et al. | |
| 2010/0125948 | A1 | 5/2010 | Johnson-Jones | |
| 2011/0258776 | A1* | 10/2011 | Schwartz | A47D 7/00 5/100 |
| 2013/0185867 | A1 | 7/2013 | Long | |
| 2022/0007853 | A1* | 1/2022 | Guo | A47D 9/012 |

FOREIGN PATENT DOCUMENTS

| | | | | | |
|---|---|---|---|---|---|
| CN | 212233857 | U | | 12/2020 | |
| CN | 112806776 | A | | 5/2021 | |
| CN | 113425123 | A | * | 9/2021 | A47D 7/02 |
| CN | 114515082 | A | | 5/2022 | |
| CN | 114515082 | B | * | 8/2024 | A47D 7/002 |
| EP | 3354164 | A1 | | 8/2018 | |
| JP | S4212879 | Y1 | | 7/1967 | |
| JP | 2009112812 | A | | 5/2009 | |
| JP | 2022507951 | A | | 1/2022 | |
| JP | 2022516448 | A | * | 2/2022 | A47D 9/012 |
| KR | 20220011609 | A | | 1/2022 | |
| TW | 479491 | U | | 3/2002 | |
| TW | 202119983 | A | | 6/2021 | |
| WO | 02087394 | A2 | | 11/2002 | |

OTHER PUBLICATIONS

Translation CN-114515082-B (Year: 2025).*
Translation JP-2022516448-A (Year: 2025).*
International Search Report and Written Opinion issued in PCT/EP2023/055962; mailed Jun. 20, 2023; 7 pgs.
Taiwan 1st Office Action issued in corresponding Taiwan Application No. 112108715, dated Jul. 20, 2023, pp. 1-9.
First Office Action in Corresponding Japanese Application No. 2024-553905, dated Jul. 23, 2025; 8 pgs.
Search Report in Corresponding Japanese Application No. 2024-553905, dated Jul. 3, 2024; 75 pgs.
First Office Action in Corresponding Chinese Application No. 2022102334618, dated Nov. 8, 2025; 13 pgs.
First Office Action in Corresponding Korean Application No. 10-2024-7032724, dated Jan. 5, 2026; 18 pgs.

* cited by examiner

CHILD BED

CROSS-REFERENCE TO RELATED APPLICATIONS

This application is a National Stage application of PCT/EP2023/055962, entitled "CHILD BED" and filed on Mar. 9, 2023, which claims the benefit of Chinese Application No. 202210233461.8, filed on Mar. 10, 2022, both of which are incorporated herein by reference in their entirety.

TECHNICAL FIELD

The present application relates to a child bed.

DESCRIPTION

A child bed, also known as a crib, is a widely used infant product. Specifically, a child bed/crib is an infant product for a baby to rest, which provides convenience for a caregiver to look after the baby. At present, there are many cribs with different shapes, structures and folding principles on the market.

In order to facilitate the caregiver to take care of the infant in the child bed on a side of the child bed, an armrest on one side of the child bed is arranged to be adjustable up and down. When the child bed is used, the armrest on the side close to the caregiver can be adjusted to the lowest position. Under the condition that only one armrest at a certain side can be adjusted, if the caregiver is located at the side where the adjustable armrest is not located, the child bed needs to be rotated 180 degrees such that the infant can be looked after from the side where the adjustable armrest is located, which will cause inconvenience in use.

Accordingly, it is necessary to provide a child bed with adjustable armrests on both sides, and the adjustable armrests on both sides are not interfere with each other.

A child bed according to the application comprises a frame, and the frame comprises: a plurality of vertical support members, arranged at corners of the frame; two top side rods, extending longitudinally and arranged transversely opposite to each other on the vertical support members, wherein each of the top side rods is able to vertically slide between a high position and a low position with respect to the vertical support members; two side pull-rods, extending longitudinally and arranged transversely opposite to each other respectively below the corresponding top side rods; and two tightening mechanisms, wherein each one of the side pull-rods is pulled toward the other one of the side pull-rods by corresponding one of the tightening mechanisms.

In one embodiment, each of the side pull-rod is able to slide transversely toward the opposite one of the side pull-rods.

In one embodiment, two side shrouds, wherein each of the side shrouds is connected between the side top rod and the side pull-rod that are located on a same side, such that a transverse sliding of each of the side pull-rods is able to drive the side top rod on the same side to slide vertically.

In one embodiment, the child bed is in a generally rectangular shape from a top view, the top side rods are arranged at two long sides of the child bed, and two of the vertical support members are respectively provided at two ends of each of the top side rods; and each of the tightening mechanisms includes two sets of elastic members respectively corresponding to the two side pull-rods, and each set of the elastic members are connected between a middle area of the corresponding side pull-rod on one side and bottom ends of two of the vertical support members that are located at the opposite side in the form of two non-parallel sides of an isosceles trapezoid.

In one embodiment, each set of the elastic members includes two extension springs.

In one embodiment, each of the top side rods comprises: a locking mechanism, disposed at both ends of each of the top side rods, being able to lock the top side rods on the vertical support members, or being unlocked such that the top side rods are able to vertically slide with respect to the vertical support members; an unlocking mechanism, disposed in a middle of each of the top side rods; and a dragging member, connected between the locking mechanism and the unlocking mechanism, and an operation of the unlocking mechanism is able to drive the dragging member to move and unlock the locking mechanism.

In one embodiment, when the locking mechanisms are unlocked, the top side rods are able to automatically move to the low position under an action of the tightening mechanisms.

In one embodiment, the two tightening mechanisms are disposed at a bottom of the frame, and are vertically separated by a partition board laid at the bottom of the frame.

In one embodiment, the partition board is laid all over the bottom of the frame and is fixed to cross bars at bottom ends of transverse sides of the frame.

In one embodiment, two vertical support members located at two ends of the top side rods are provided with two chutes that vertically extend and are face-to-face arranged, such that both ends of each of top side rods are inserted into and vertically slide along the chutes.

In one embodiment, two bottom side rods, respectively parallel to the corresponding top side rods and fixed at lower ends of the vertical support members, each of the side shrouds crosses one of the bottom side rods under the bottom side rod and is connected between one of the top side rods and a corresponding one of the side pull-rods.

In one embodiment, the top side rods, the bottom side rods, and the side pull-rods have approximately the same length.

In one embodiment, two end plates, respectively located at two longitudinal ends of the frame; each of the end plates has a plurality of through holes, and the through holes are arranged in a staggered manner along a plurality of horizontal rows; and legs, located below the frame and support the frame.

In one embodiment, when viewed in the vertical direction, each of the end plates is generally U-shaped and includes an end plate transverse portion and one of the vertical support members connected to two lateral ends of the end plate transverse portion.

BRIEF DESCRIPTION OF THE DRAWINGS

FIG. 3 corresponding to FIG. 1 schematically shows the side shrouds, the side pull-rods, the dragging members and the like;

FIG. 6 corresponding to FIG. 5 schematically shows the side shrouds, the side pull-rods, the dragging members and the like;

DETAILED DESCRIPTION OF THE DRAWINGS

Figure 1:
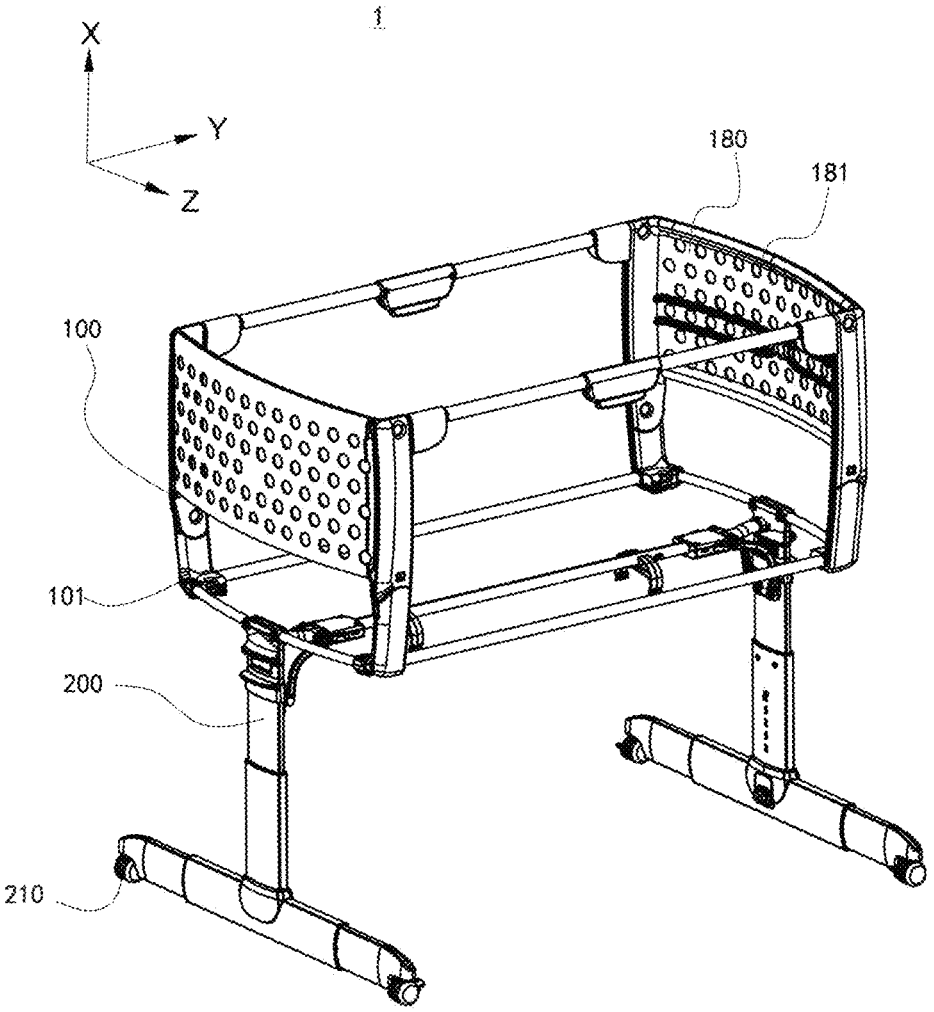
FIG. 1 is a perspective view schematically showing the child bed according to the application, in which the top side rods are in a high position, and only a part of the structure is shown, but the side shrouds, the side pull-rods, the partition board and the like are not shown.

Although the present invention is illustrated and described herein with reference to specific embodiments, the invention should not be limited to the details shown. Exactly, many modifications can be made to these details within the scope of the equivalents of the claims without departing from the invention.

The directional descriptions of "front," "back," "up," and "down" involved herein are only for convenience of understanding. The invention is not limited to these directions but can be adjusted according to the actual situation. Although the application will be described with reference to typical 20 embodiments, the terms used are illustrative and exemplary, not restrictive.

Reference is made to FIG. 1 to FIG. 4. A child bed 1 according to the application will be described as a whole. The child bed 1 includes a frame 100 and a bottom shroud wrapped under the frame 100. However, in order to clearly show other parts of the child bed 1, the bottom shroud is not shown in the drawings.

In the illustrated embodiment, the child bed 1 is generally rectangular from a top view. The frame 100 includes two end plates 180, two top side rods 120, and two bottom side rods 130. When viewed in a vertical direction, the child bed 1 is generally rectangular, the top side rods 120 are arranged at two long sides of the child bed 1, and the two end plates 180 are respectively provided at two ends of each of the top side rods 120.

However, in another embodiment, the child bed 1 may also have different shapes. As long as the child bed 1 has two opposite sides, the side rod structures provided in the present disclosure may be used. Therefore, the end plates 180 may be replaced with arc plates or the like. In another embodiment, the frame 100 includes four vertical rods, and the four vertical rods are respectively arranged at two ends of each top side rod 120.

In this embodiment, the end plates 180 are provided at each corner 101 of the frame 100. The two top side rods 120 extend longitudinally and are arranged transversely opposite to each other on the end plates 180, and each of the top side rods 120 can vertically slide between a high position and a low position with respect to the end plates 180. More specifically, the high and low positions of the top side rods 120 may respectively correspond to an upper end and a lower end of each of the end plates 180. In this way, when one of the top side rods 120 is in the high position, one side of the child bed 1 where the top side rod is located at the high position is closed. Moreover, when one of the top side rods 120 is in the lower position, one side of the child bed 1 where the top side rods 120 is located at the lower position is opened.

The two bottom side rods 130 are respectively parallel to the corresponding top side rods 120 and fixed on plastic components located at the lower ends of the end plates 180. Each of the side shrouds 150 bypasses one of the bottom side rods 130 from the bottom side thereof and is connected between one of the top side rods 120 and the corresponding one of the side pull-rods 140.

Two side pull-rods 140 extend longitudinally and are arranged transversely opposite to each other below the corresponding top side rods 120, and each side pull-rod 140 can slide transversely toward the opposite side pull-rod 140. Each of the two side shrouds 150 is connected between the top side rod 120 and the side pull-rod 140 on a same side, such that a transverse sliding of the side pull-rod 140 may drive the side top rod 120 on the same side to slide vertically.

Figure 5:
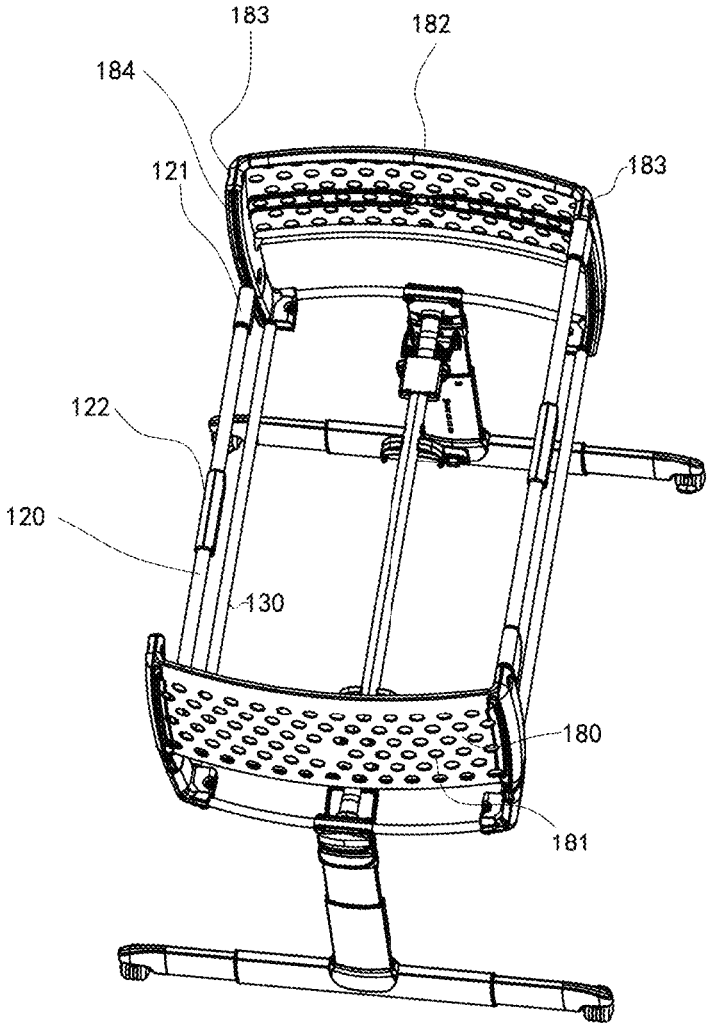
FIG. 5 is a perspective schematic view showing the child bed according to the application, in which one of the top side rods is in a low position, and only a part of the structure is shown, but the side shrouds, the side pull-rods, the dragging member and the partition board are not shown.

When viewed in the vertical direction, each of the end plates 180 is generally U-shaped, that is, it includes an end plate transverse portion 182 and two end plate longitudinal portion respectively connected to two lateral ends of the end plate transverse portion 182 (as shown in FIG. 5). The end plate longitudinal portions extend in the longitudinal and vertical directions, and are also called vertical support members 183. The vertical support members 183 are located at the corners 101 of the frame 100. Each vertical support member 183 extends towards one of the top side rods 120 and is provided with a vertically extending chute 184 so that the two ends of the top side rods 120 can be inserted into and slide vertically along the chutes 184.

The top side rod 120, the bottom side rod 130, and the side pull-rod 140 may have approximately the same length. Therefore, the side shroud 150 spread between the top side rod 120 and the side pull-rod 140 on the same side has a generally rectangular and planar shape. If one of the side pull-rods 140 at one side is dragged to the opposite side, the top side rod 120 can be pulled down to the low position via the side shroud 150. Accordingly, if the top side rod 120 is dragged to the high position, the side pull-rods 140 can be dragged back to the side where the corresponding side top rod 120 is located via the side shroud 150.

In this embodiment, the two end plates 180 are respectively located at two ends of the frame 100 in a longitudinal direction. Each of the end plates 180 has a plurality of through holes 181, and the through holes 181 are arranged in a staggered manner along a plurality of horizontal rows.

The child bed 1 is further provided with legs 200. The legs 200 are located below the frame 100 for supporting the frame 100. A wheel 210 may be disposed below each of the legs 200 for facilitating the movement of the child bed 1.

Two tightening mechanisms 160 each pull one of the side pull-rods 140 toward the other one of the side pull-rods 140. Because the side pull-rods 140 are located on a bottom surface of the child bed 1, it is difficult for the caregiver to directly operate the side pull-rods 140. Each of the tightening mechanisms 160 serve to assist the caregiver in dragging the side pull-rod 140 from one side to the opposite side, thereby dragging the corresponding top side rod 120 to the low position.

In this embodiment, each of the tightening mechanisms 160 includes two sets of elastic members respectively corresponding to the two side pull-rods 140, and each set of the elastic members are connected between a middle area of the corresponding side pull-rod 140 on one side and bottom ends of the two vertical support members 183 that are located at the opposite side in the form of two non-parallel sides of an isosceles trapezoid. Each of the bottom ends of the vertical support members 183 may be provided with a hook for connecting one of the elastic members, such that the elastic members are directly connected to the vertical support members 183. The bottom ends of the vertical support members 183 can also be connected to the corners 101, and the elastic members are connected to the corners 101, thereby being indirectly connected to the bottom ends of the vertical support members 183. Each set of the elastic members may include two extension springs.

In other embodiments, the elastic members may be arranged to jointly form a different shape from an isosceles trapezoid. For example, each set of the elastic members may include two elastic members parallel to each other, and each elastic member is connected between one of the side pull-rods 140 and the bottom side rod 130 on the opposite side.

Figure 2:
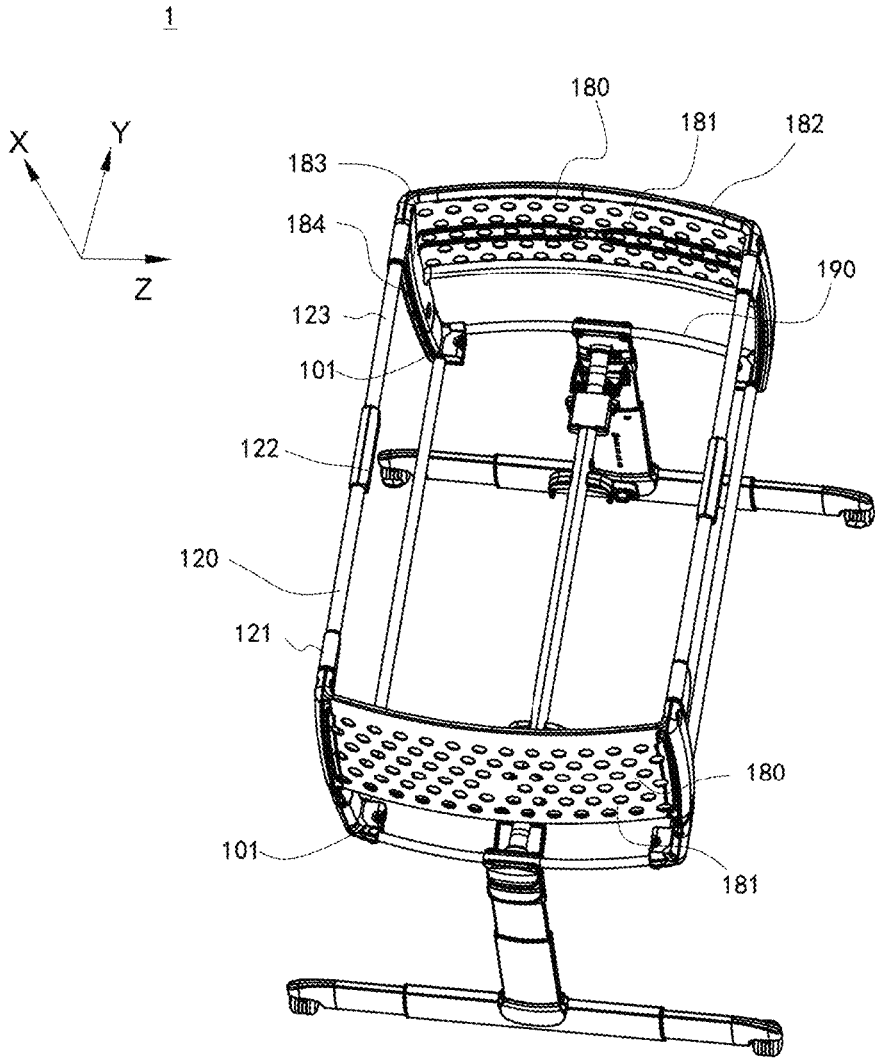
FIG. 2 corresponding to FIG. 1 schematically shows the dragging members disposed in the side top rod.
Figure 3:
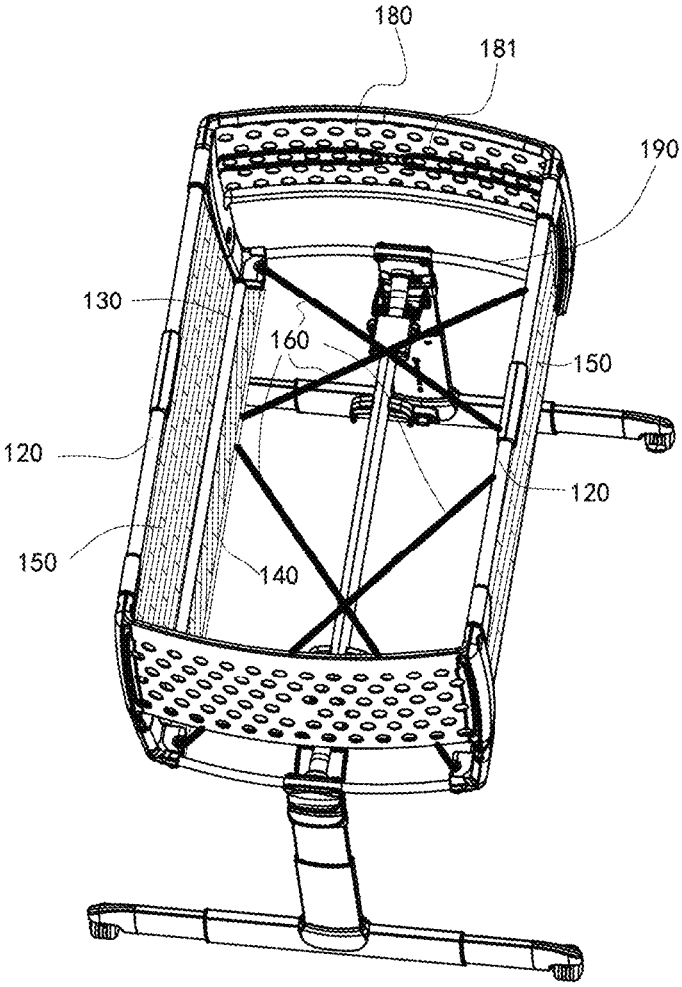

As shown in FIG. 2, in one preferred embodiment, the top side rods 120 can include a locking device. Specifically, each top side rod 120 may include a locking mechanism 121, an unlocking mechanism 122, and a dragging member 123. The locking mechanisms 121 are disposed at both ends of each of the top side rods 120, and can lock the top side rods 120 on the vertical support members 183, or be unlocked such that the top side rods 120 can vertically slide with respect to the vertical support members 183. For example, the locking device includes pins disposed at ends of the top side rods 120 and extending toward the vertical support members 183. Accordingly, the vertical support members 183 may be provided with pin holes for receiving the pins. When the pins protrude from the vertical support members 183 and are inserted into the pin holes, the top side rods 120 are locked on the vertical support members 183; moreover, when the pins retract into the top side rods 120, the top side rods 120 can move with respect to the vertical support members 183.

The unlocking mechanisms 122 are disposed in the middle of the top side rods 120. The dragging members 123 are connected between the locking mechanisms 121 and the unlocking mechanisms 122, and the operation of the unlocking mechanisms 122 can drive the dragging members 123 to move and unlock the locking mechanisms 121. In one embodiment, the unlocking mechanisms 122 are handles for grip, and the dragging members 123 are cables. When the user holds the handles to pull the dragging members 123 toward the middle of the top side rods 120, the dragging members 123 can drive the unlocking mechanisms 122 to retract into the top side rods 120.

The locking mechanisms 121 can resist the dragging force of the tightening mechanisms 160. When the locking mechanisms 121 are unlocked, the top side rods 120 can automatically move to the low position under the action of the tightening mechanisms 160.

Figure 4:
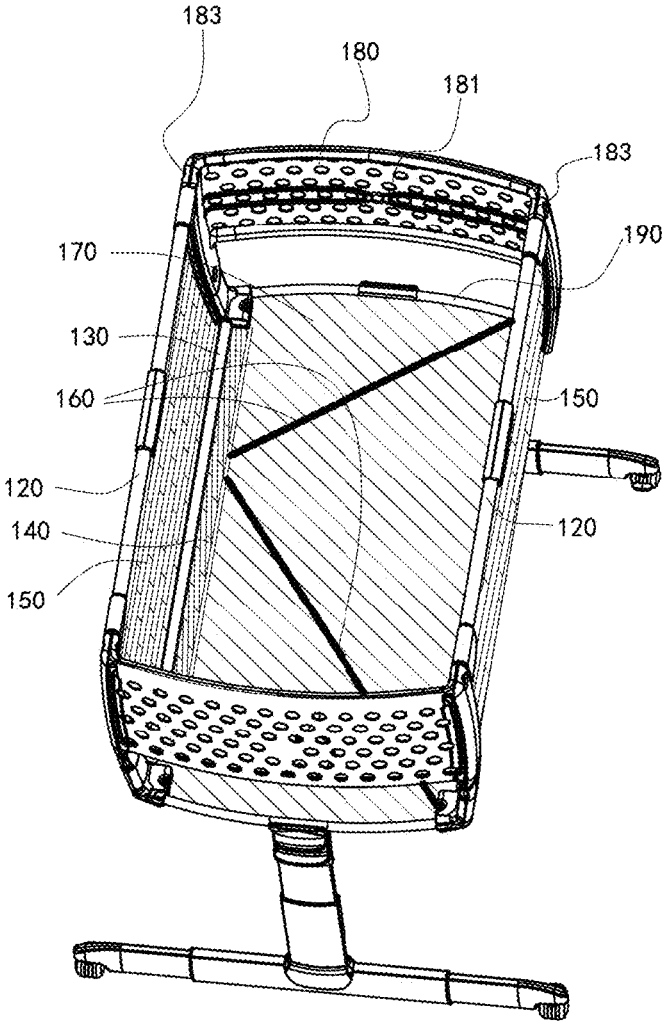
FIG. 4 corresponding to FIG. 3 schematically shows the partition board disposed between the dragging members.

As shown in FIG. 4, two tightening mechanisms 160 are disposed at the bottom of the frame 100, and are vertically separated by a partition board 170 laid at the bottom of the frame 100. Otherwise, the two tightening mechanisms 160 may interfere with each other, or even get entangled together without the partition board 170. By the arrangement of the partition board 170, interference between the two tightening mechanisms 160 is effectively avoided. In one embodiment, the partition board 170 is laid all over the bottom of the frame 100, that is, both transversal sides of the partition board 170 extend respectively to the two bottom side rods 130, and both longitudinal sides of the partition board 170 extend respectively to the lower ends of the two end plates 180 on. The partition board 170 may be fixed to cross bars 190 at the bottom ends of the transverse sides of the frame 100. Two ends of each of the cross bars 190 may be respectively connected to the bottom ends of the two vertical support members 183. In other embodiments, it is not necessary for the partition board 170 to be laid all over the bottom of the frame 100, instead, the partition board 170 occupies only a localized area of the bottom of the frame 100 for separating the two tightening mechanisms 160.

Figure 6:
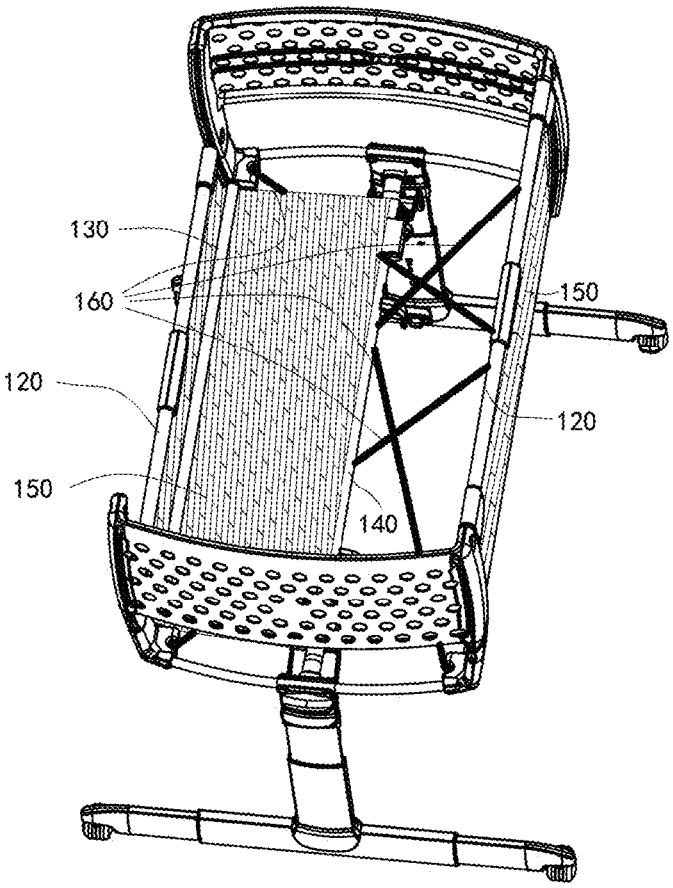
Figure 7:
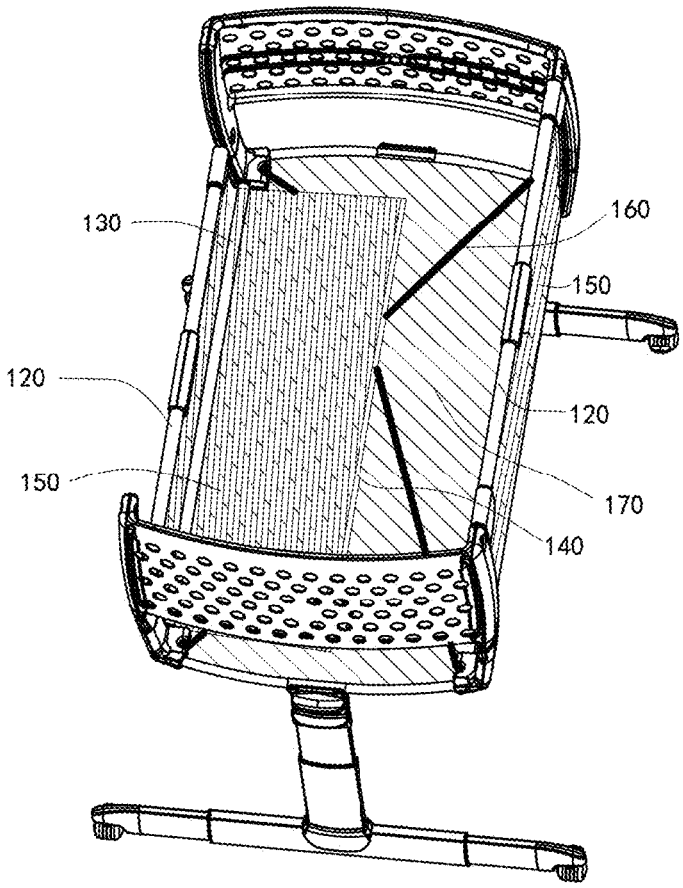
FIG. 7 corresponding to FIG. 6 schematically shows the partition board disposed between the dragging members.

Reference is made to FIGS. 5 to 7, which show a circumstance that the top side rod 120 on one side moves to the low position. During the process of the top side rod 120 moving from the high position to the low position, the side shroud 150 wraps around the outside of the bottom side rod 130. Therefore, the side shroud 150 transits from one state in which the side shroud 150 extends roughly along the side surface (as shown in FIG. 4) to another state in which the side shroud 150 extends along both the side surface and the bottom surface in a zigzag pattern, and finally transits to a final state in which the side shroud 150 extends roughly along the bottom surface (as shown in FIG. 6). Due to the size difference between the side surface and the bottom surface of the frame 100, the side shroud 150 may not be laid all over the bottom surface, and the side pull-rod 140 may not completely move to the opposite side. When the top side rod 120 moves to the bottom ends of the end plates 180, the side pull-rod 140 would stop moving and do not reach the opposite side, thus in the state shown in FIGS. 5 to 7.

Figure 8:
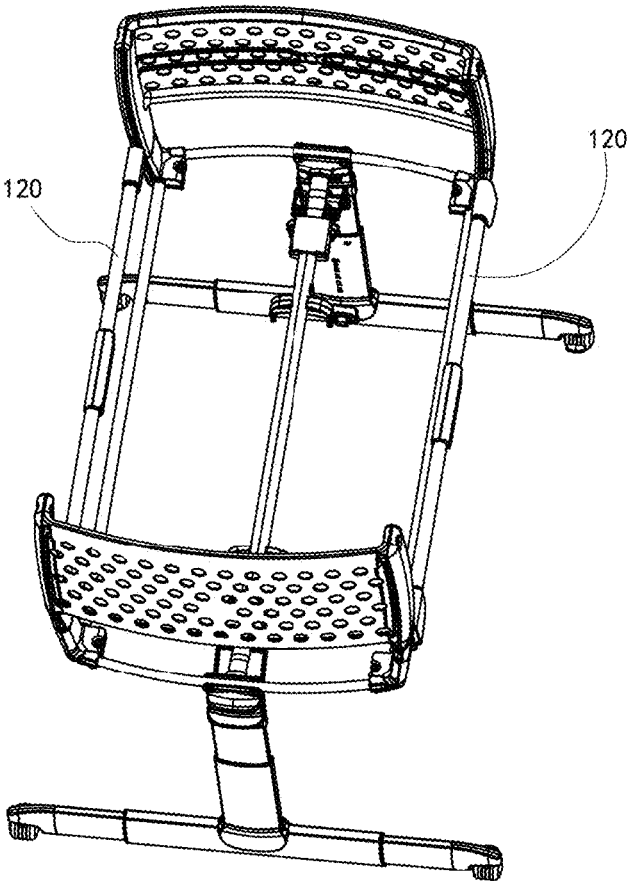
FIG. 8 is a perspective schematic view showing the child bed according to the application, in which the two top side rods are in a low position, and only part of the structure is shown, but the side shrouds, the side pull-rods, the dragging members and the partition board are not shown.

Reference is made to FIG. 8, which shows a circumstance that all the two top side rods 120 are moved to the low position. According to the above description, it should be understood, the movements of the top side rods 120, the side pull-rods 140, and the side shrouds 150 on both sides do not interfere with each other. The caregiver can arbitrarily set the top side rod 120 on one side or set the top side rods 120 on both sides in the high position or the low position according to actual implementations.

To sum up, a child bed is provided in the present disclosure, and the child bed are provided with top side rods having adjustable heights at both sides thereof. Moreover, the top side rods of the present disclosure on both sides are provided with tightening mechanisms, and the tightening mechanisms on both sides do not interfere with each other. Therefore, the child bed of the present disclosure is convenient for height adjustment of the two top side rods.

Since the application can be embodied in various forms without departing from the spirit and essence of the application, it should be understood, the above embodiments are not limited to any of the foregoing details, but should be interpreted in the broadest sense within the scope defined by the claims. Therefore, all changes that fall within the scope of the claims or their equivalents should be covered by the claims.

LIST OF REFERENCE SIGNS

1 Child bed
100 Frame
101 Corner
120 Top side rod
121 Locking Mechanism
122 Unlocking Mechanism
123 Dragging Member
130 Bottom side rod
140 Side Pull-Rod
150 Side Shroud
160 Tightening Mechanism
170 Partition Board
180 End Plate
181 Through Hole

182 End plate Transverse Portion
183 Vertical Support Member (End Plate Longitudinal Portion)
184 Chute
190 Cross bar
200 Leg
210 Wheel
X Vertical direction
Y Longitudinal direction
Z Transverse direction

The invention claimed is:

1. A child bed comprising a frame, wherein the frame comprises:

a plurality of vertical support members, arranged at corners of the frame;

two top side rods, extending longitudinally and arranged transversely opposite to each other on the vertical support members, wherein each of the top side rods is able to vertically slide between a high position and a low position with respect to the vertical support members;

two side pull-rods, extending longitudinally and arranged transversely opposite to each other respectively below the corresponding top side rods; and two tightening mechanisms, wherein each one of the side pull-rods is pulled toward the other one of the side pull-rods by a corresponding one of the tightening mechanisms.

2. The child bed according to claim 1, wherein:

each of the side pull-rods is able to slide transversely toward the opposite one of the side pull-rods.

3. The child bed according to claim 1, further comprising:

two side shrouds, wherein each of the side shrouds is connected between the side top rod and the side pull-rod that are located on a same side, such that a transverse sliding of each of the side pull-rods is able to drive the side top rod on the same side to slide vertically.

4. The child bed according to claim 1, wherein:

the child bed is in a generally rectangular shape from a top view, the top side rods are arranged at two long sides of the child bed, and two of the vertical support members are respectively provided at two ends of each of the top side rods; and each of the tightening mechanisms includes two sets of elastic members respectively corresponding to the two side pull-rods, and each set of the elastic members are connected between a middle area of the corresponding side pull-rod on one side and bottom ends of two of the vertical support members that are located at the opposite side in the form of two non-parallel sides of an isosceles trapezoid.

5. The child bed according to claim 4, wherein:

each set of the elastic members includes two extension springs.

6. The child bed according to claim 1, wherein:

each of the top side rods comprises:

a locking mechanism, disposed at both ends of each of the top side rods, being able to lock the top side rods on the vertical support members, or being unlocked such that the top side rods are able to vertically slide with respect to the vertical support members;

an unlocking mechanism, disposed in a middle of each of the top side rods; and a dragging member, connected between the locking mechanism and the unlocking mechanism, and an operation of the unlocking mechanism is able to drive the dragging member to move and unlock the locking mechanism.

7. The child bed according to claim 6, wherein:

when the locking mechanisms are unlocked, the top side rods are able to automatically move to the low position under an action of the tightening mechanisms.

8. The child bed according to claim 1, wherein:

the two tightening mechanisms are disposed at a bottom of the frame, and are vertically separated by a partition board laid at the bottom of the frame.

9. The child bed according to claim 8, wherein:

the partition board is laid all over the bottom of the frame, and is fixed to cross bars at bottom ends of transverse sides of the frame.

10. The child bed according to claim 4, wherein:

the two vertical support members located at two ends of the top side rods are provided with two chutes that vertically extend and are face-to-face arranged, such that both ends of each of top side rods are inserted into and vertically slide along the chutes.

11. The child bed according to claim 3, wherein the frame further comprises:

two bottom side rods, respectively parallel to the corresponding top side rods and fixed at lower ends of the vertical support members, each of the side shrouds crosses one of the bottom side rods under the bottom side rod and is connected between one of the top side rods and a corresponding one of the side pull-rods.

12. The child bed according to claim 11, wherein:

the top side rods, the bottom side rods, and the side pull-rods have approximately the same length.

13. The child bed according to claim 1, wherein the frame further comprises:

two end plates, respectively located at two longitudinal ends of the frame;

each of the end plates has a plurality of through holes, and the through holes are arranged in a staggered manner along a plurality of horizontal rows; and legs, located below the frame and support the frame.

14. The child bed according to claim 13, wherein:

when viewed in the vertical direction, each of the end plates is generally U-shaped and includes an end plate transverse portion and one of the vertical support members connected to two lateral ends of the end plate transverse portion.

* * * * *